US008418407B2

(12) United States Patent
Wang

(10) Patent No.: US 8,418,407 B2
(45) Date of Patent: Apr. 16, 2013

(54) SAFETY GATE

(76) Inventor: Tsung-Hsiang Wang, New Taipei (TW)

( * ) Notice: Subject to any disclaimer, the term of this patent is extended or adjusted under 35 U.S.C. 154(b) by 147 days.

(21) Appl. No.: 13/167,120

(22) Filed: Jun. 23, 2011

(65) Prior Publication Data

US 2012/0324796 A1 Dec. 27, 2012

(51) Int. Cl.

| | |
|---|---|
| ***E05C 21/02*** | (2006.01) |
| ***E06B 3/68*** | (2006.01) |
| ***E06B 7/00*** | (2006.01) |
| ***E06B 9/01*** | (2006.01) |

(52) U.S. Cl.

USPC ..... 49/465; 49/463; 49/55; 49/57

(58) Field of Classification Search ..... 49/50, 55–57, 49/449, 451, 463–465, 52, 53; 160/216, 160/225; 292/256, 256.69, 256.71, 256.73, 292/256.75, 257, 258, 262, 266, 267, 269, 292/270, 273, 274, 277, 278, 305, 306, DIG. 29

See application file for complete search history.

(56) References Cited

U.S. PATENT DOCUMENTS

| | | | | |
|---|---|---|---|---|
| 4,958,867 | A * | 9/1990 | Champagne | 292/259 R |
| 5,131,186 | A * | 7/1992 | Lamont | 49/57 |
| 5,442,881 | A * | 8/1995 | Asbach et al. | 49/465 |
| 5,528,859 | A * | 6/1996 | Taylor et al. | 49/55 |
| 5,535,552 | A * | 7/1996 | Stern | 49/465 |
| 5,657,809 | A * | 8/1997 | Longoria et al. | 160/369 |
| 5,782,039 | A * | 7/1998 | Scherer et al. | 49/465 |
| 6,233,874 | B1 * | 5/2001 | Johnson, Jr. | 49/465 |
| 8,261,490 | B2 * | 9/2012 | Flannery et al. | 49/55 |
| 2007/0144691 | A1 * | 6/2007 | Yates | 160/377 |

* cited by examiner

*Primary Examiner* — Katherine Mitchell

*Assistant Examiner* — Scott Denion

(74) *Attorney, Agent, or Firm* — The Weintraub Group, P.L.C.

(57) ABSTRACT

A safety gate has two frame assemblies, a shaft fixing assembly and a stretcher assembly. A relative distance between the two frame assemblies is fixed by the shaft fixing assembly first. The stretcher assembly further pushes the two frame assemblies outwardly so that the two frame assemblies tightly abut against two walls of a mounting premise and can be held on the walls securely. When the safety gate is not in use, the stretcher assembly is released to loosen the safety gate from the walls and the stretcher assembly can be moved to elsewhere. As the safety gate can be repeatedly mounted without having to readjust the relative distance between the two frame assemblies with the shaft fixing assembly, the operation of the safety gate is easy and convenient.

16 Claims, 9 Drawing Sheets

SAFETY GATE

BACKGROUND OF THE INVENTION

1. Field of the Invention

The present invention relates to a safety gate, and more particularly to a safety gate capable of locking a distance between two sides of the safety gate for the purpose of repeated mountings.

2. Description of the Related Art

Safety gates serve to block young children or pets at the top of stairs for a fall protection or at the entrance to a room, such as kitchen or living room, to limit the infants or pets to stay in the room or from accessing the room.

A conventional safety gate substantially comprises two movable frames and a fixing element. After the two movable frames are adjusted to abut against two opposite sides of an entrance, the fixing element is used to keep the movable frames at the relative distance so that the safety gate can be tightly mounted on the sides of the entrance in completion of the mounting process.

A successful mounting of the conventional safety gate relies on simultaneous and tight contact of the edges of the movable frames with the door frame and the locking of the fixing element at the same time to prevent the safety gate from easily toppling and falling, but it is rather difficult for only one person to independently mount the conventional safety gate.

In addition, a stretcher element is further provided to slightly stretch the two movable frames outwardly to abut against two sides of an entrance. Therefore, when the relative distance between the two movable frames is adjusted, contact tightness between two sides of the entrance and the two movable frames may not be critical as the stretcher element makes the mounting of such safety gate easier and more secure.

However, the fixing elements and the stretcher elements of the conventional safety gates are designed and manufactured in combination, or in other words, they can only be operated at the same time. When the safety gate is dismounted and the stretcher element is released, the two movable frames are unattached to the sides of the entrance, and the relative distance between the movable frames for mounting is easily altered after the safety gate is dismounted. As a result, the relative distance between the movable frames needs to be repeatedly adjusted even though the safety gate is mounted at a same place again. Such readjustment over and over again causes inconvenience in use and the conventional safety gates need to be further improved.

SUMMARY OF THE INVENTION

An objective of the present invention is to provide a safety gate capable of locking a distance between two sides of the safety gate for the purpose of repeated mountings.

To achieve the foregoing objective, the safety gate has a first frame assembly, a second frame assembly, a shaft fixing assembly and a stretcher assembly.

The first frame assembly has a first frame, a first shaft rack and a first shaft. The first shaft rack is mounted on one side edge of the first frame in a transverse direction. The first shaft is securely mounted on the first shaft rack.

The second frame assembly is adjacent to the other side edge of the first frame in the transverse direction and has a second frame, a second shaft rack and a second shaft. The second frame is mounted between the first frame and the first shaft. The second shaft rack is mounted on a side edge of the second frame adjacent to the first shaft rack in the transverse direction, and has a rack abutting surface formed on the second shaft rack and faces the first shaft rack. The second shaft is securely mounted on the second shaft rack and is transversely slidable when combined with the first shaft.

The shaft fixing assembly is mounted around the first shaft and has a clamping sleeve, a compression arm and a stretcher assembly. The clamping sleeve is mounted around the first shaft and has two open sides, an open top, a chamber, two pressing walls, two pressing protrusions, two positioning grooves, two first pivot holes and two second pivot holes. The chamber is defined in the clamping sleeve and communicates with the open sides and the open top. A section of the chamber along a longitudinal direction perpendicular to the transverse direction corresponds to that of the first shaft along the longitudinal direction. The pressing walls are respectively formed on and protrude upwardly from two top portions of the clamping sleeve. The pressing protrusions are respectively formed on and protruding outwardly from peripheries of the two pressing walls. The positioning grooves are respectively formed in the peripheries of the two pressing walls. Each first pivot hole is formed through one end of one of the pressing walls facing the first shaft rack and aligning with the other first pivot hole. Each second pivot hole is formed through the other end of one of the pressing walls away from the first shaft rack and aligns with the other second pivot hole.

The compression arm is mounted above the clamping sleeve and has an open side, an open bottom, two inner walls, a chamber, two walls and two positioning ribs. The inner walls are opposite to each other. The chamber is defined in the compression arm and communicates with the open side and the open bottom. The walls sandwich the chamber and are respectively mounted on the peripheries of the pressing walls when the compression arm is pivoted downwardly to rest on the pressing walls. The positioning ribs are respectively formed on and protrude from the two inner walls of the compression arm and respectively align with the positioning grooves. One end of the compression arm is pivotally connected to the first pivot holes of the pressing walls.

The stretcher assembly is mounted around the first shaft, the clamping sleeve and the compression arm, is pivotally connected to the second pivot holes of the clamping sleeve and has a top surface and two sidewalls. The top surface has a top hole formed through one end of the top surface opposite to the first shaft rack. Each sidewall has a first abutting edge, a second abutting edge and a pivot hole. The first abutting edge is intersected by the top surface of the stretcher assembly and the sidewall. The second abutting edge is connected with the first abutting edge and is opposite to the first shaft rack. The pivot hole is formed through the sidewall to align with the pivot hole of the other sidewall, and is pivotally connected to the second pivot holes of the clamping sleeve. A distance from the pivot hole to the first abutting edge is smaller than a distance from the pivot hole to the second abutting edge.

The shaft fixing assembly serves to fix a relative distance between the first frame and the second frame. The stretcher assembly and the second shaft rack are used to further stretch out the first frame and the second frame so that the safety gate tightly abuts against two walls of a mounting premise and does not topple. When the safety gate is not in use, the safety gate can be loosened easily from the walls after the stretcher assembly is released and the safety gate can be then moved to elsewhere for storing. Without the readjustment of the shaft fixing assembly, the same relative distance between the first frame and the second frame can be repeatedly applied to subsequent mountings. Accordingly, the safety gate can be mounted easily and conveniently.

Other objectives, advantages and novel features of the invention will become more apparent from the following detailed description when taken in conjunction with the accompanying drawings.

DETAILED DESCRIPTION OF THE INVENTION

Figure 1:
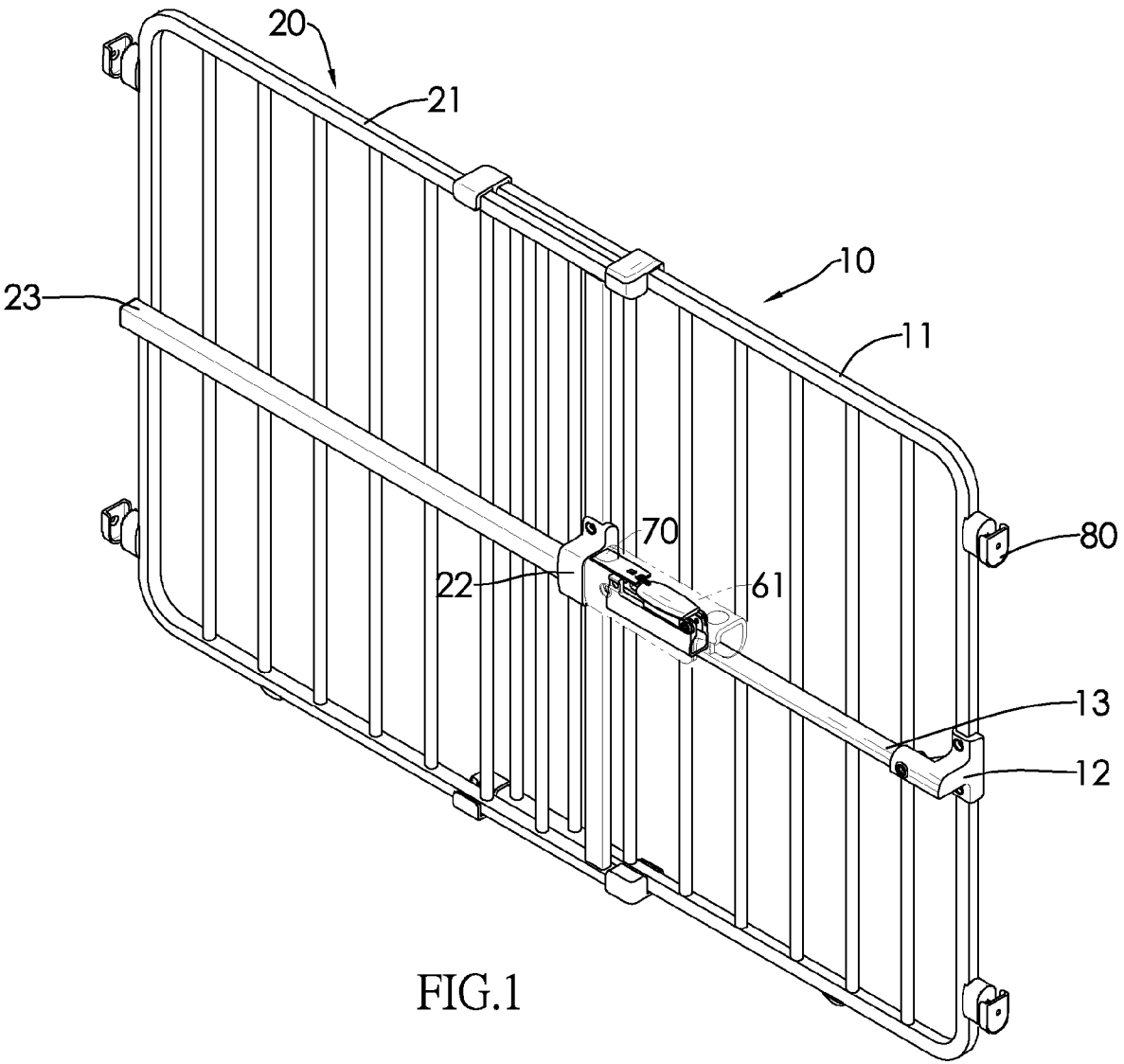
FIG. 1 is a perspective view of a safety gate in accordance with the present invention.
Figure 2:
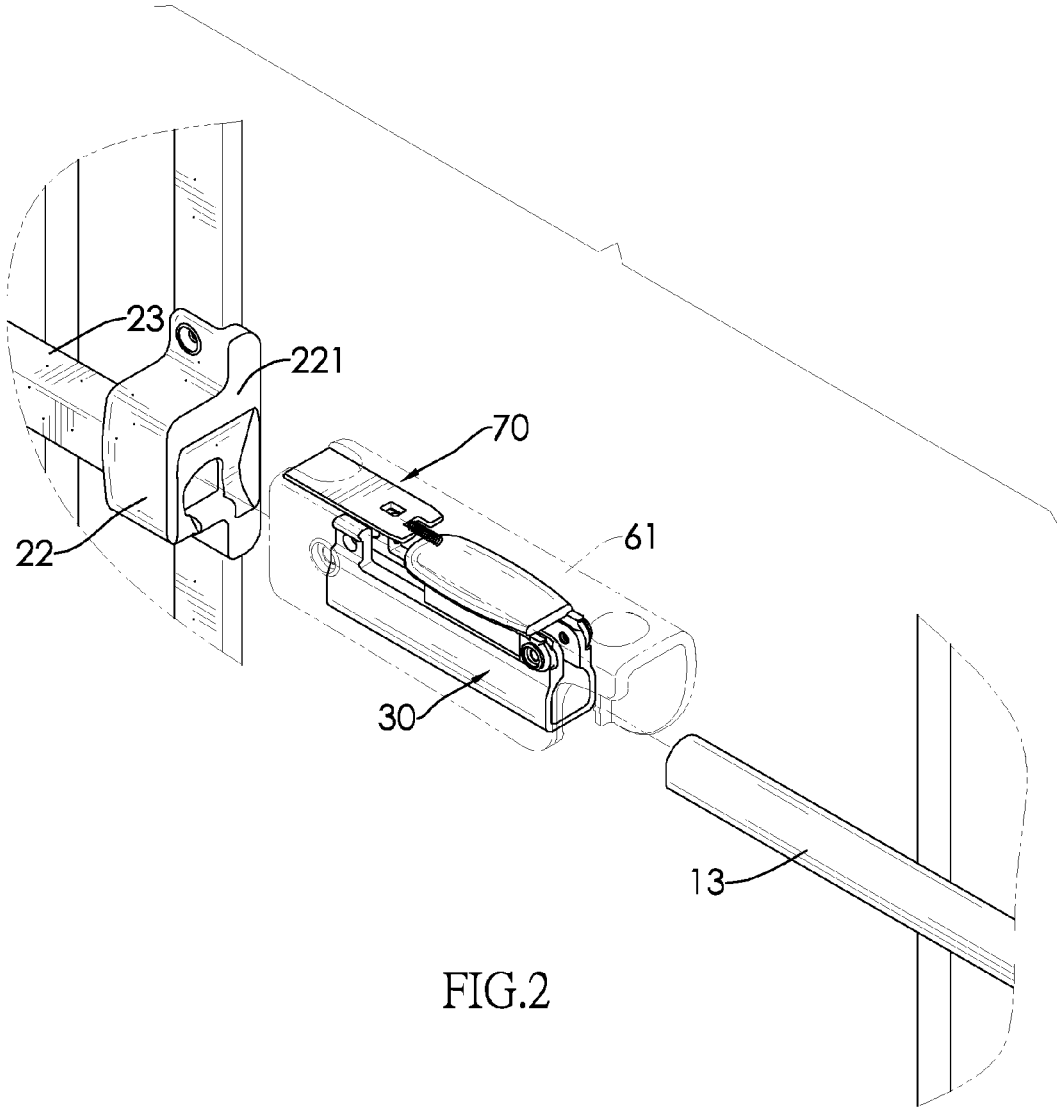
FIG. 2 is a first enlarged exploded perspective view of the safety gate in FIG. 1.
Figure 3:
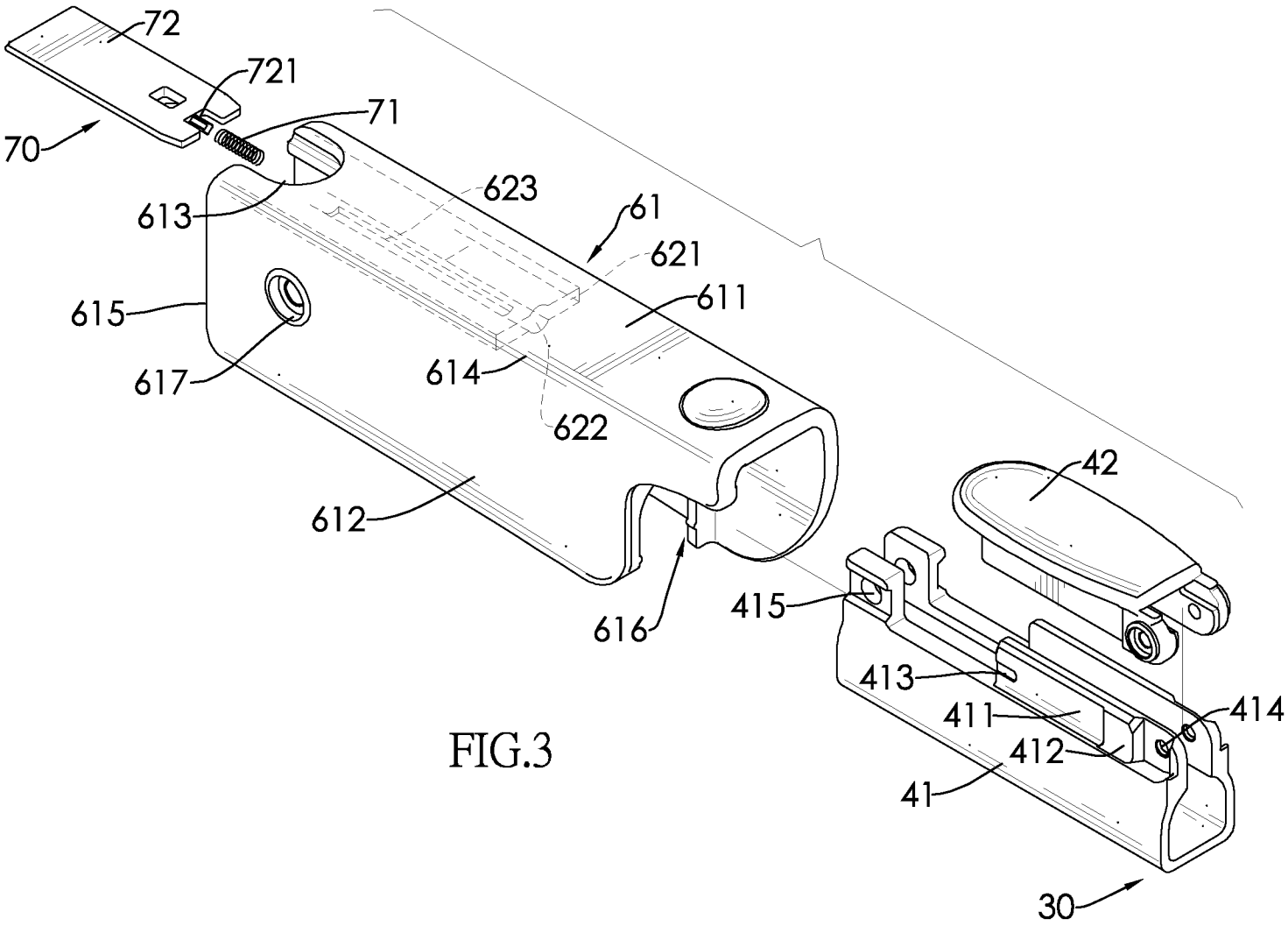
FIG. 3 is a second enlarged exploded perspective view of the safety gate in FIG. 1.
Figure 4:
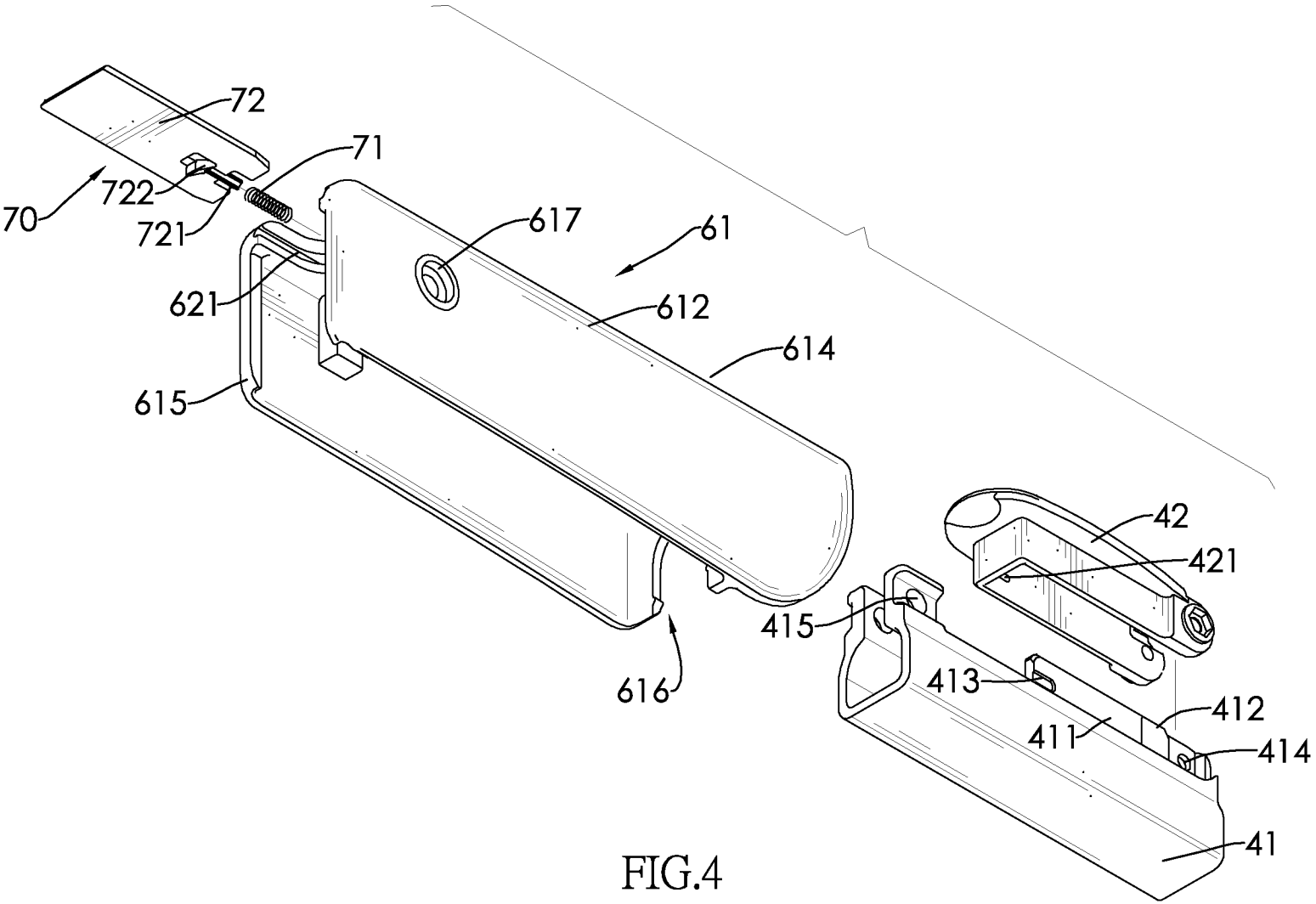
FIG. 4 is a third enlarged exploded perspective view of the safety gate in FIG. 1.
Figure 5:
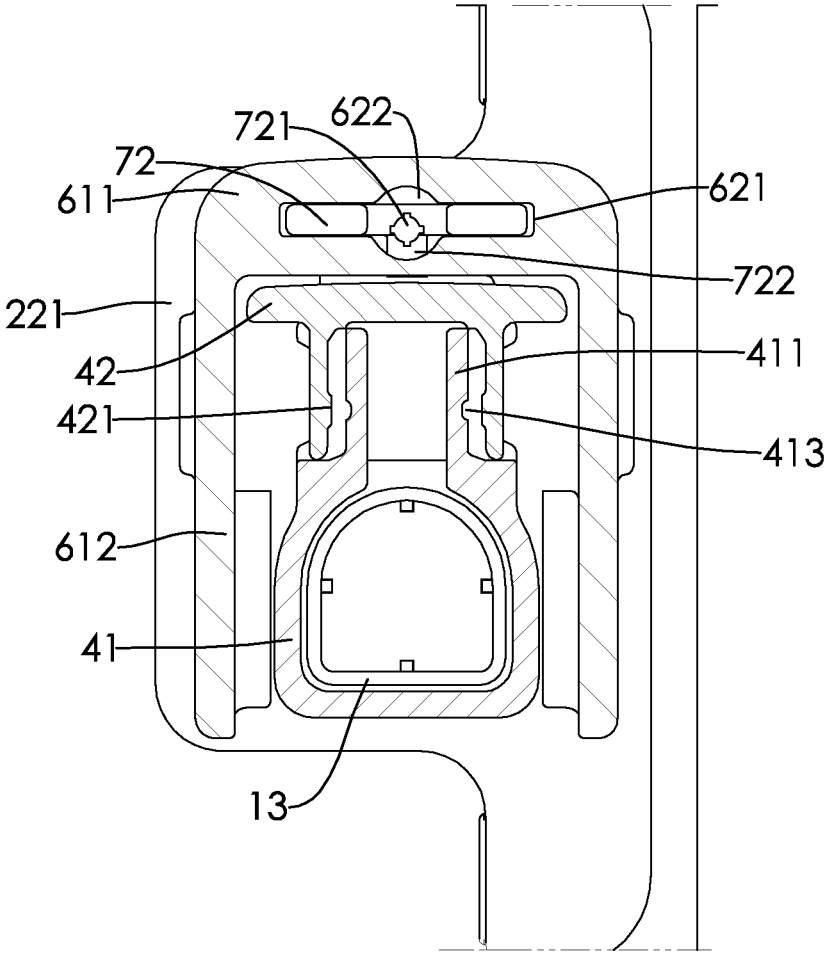
FIG. 5 is an enlarged side view in partial section of the safety gate in FIG. 1.

With reference to FIGS. 1 and 2, a safety gate in accordance with the present invention has a first frame assembly 10, a second frame assembly 20, a shaft fixing assembly 40, a stretcher assembly 61, an anti-pinch assembly 70 and multiple contact pads 80.

With reference to FIGS. 1 to 5, the first frame assembly 10 has a first frame 11, a first shaft rack 12 and a first shaft 13. The first shaft rack 12 is mounted on one side edge of the first frame 11 in a transverse direction. The first shaft 13 is securely mounted on the first shaft rack 12 and has a non-circular section.

The second frame assembly 20 is adjacent to the other side edge of the first frame 11 in the transverse direction and has a second frame 21, a second shaft rack 22 and a second shaft 23. The second frame 21 is mounted between the first frame 11 and the first shaft 13. A slider is mounted on each of the top edges and the bottom edges of the first frame 11 and second frame 21 so that the first frame 11 and the second frame 21 can be smoothly slidable relative to each other and a length between outer edges of the first frame assembly 10 and the second frame assembly 20 of the safety gate in the transverse direction can be telescopic. The second shaft rack 22 is mounted on a side edge of the second frame 21 adjacent to the first shaft rack 12 in the transverse direction, and has a rack abutting surface 221 formed thereon and facing the first shaft rack 12. The second shaft 23 is securely mounted on the second shaft rack 22 and is transversely slidable when combined with the first shaft 13. In the present embodiment, the second shaft 23 is hollow and tubular and has an opening formed through one end of the second shaft 23 facing the second shaft rack 22. The second shaft 23 is unrotatably mounted around the first shaft 13.

The shaft fixing assembly 40 is mounted around the first shaft 13 and may be securely mounted on the first shaft 13 that has a non-circular section. The shaft fixing assembly 40 has a clamping sleeve 41 and a compression arm 42. The clamping sleeve 41 has two open sides, an open top, a chamber, two pressing walls 411, two pressing protrusions 412, two positioning grooves 413, two first pivot holes 414 and two second pivot holes 415. The chamber is defined in the clamping sleeve 41 and communicates with the open sides and the open top. A cross section of the chamber along a longitudinal direction that is perpendicular to the transverse direction corresponds to that of the first shaft 13 along the longitudinal direction. The two pressing walls 411 are respectively formed on and protrude upwardly from two top portions of the clamping sleeve 41. The two pressing protrusions 412 are respectively formed on and protrude outwardly from peripheries of the two pressing walls 411. The two positioning grooves 413 are respectively formed in the peripheries of the two pressing walls 411. Each first pivot hole 414 is formed through one end of one of the pressing walls 411 facing the first shaft rack 12 and aligns with the other first pivot hole 414. One end of the compression arm 42 is pivotally connected to the first pivot holes 414 of the pressing walls 411 and is located above the clamping sleeve 41. The second pivot holes 415 are respectively formed through two rear top edges of the clamping sleeve 41 beside the open top and align with each other. The compression arm 42 has an open side, an open bottom and a chamber defined in the compression arm 42 and communicating with the open side and the open bottom. Two walls of the compression arm 42 between which the chamber is defined are respectively mounted on the peripheries of the pressing walls 411 when the compression arm 42 is pivoted downwardly to rest on the pressing walls 411. The compression arm 42 has two positioning ribs 421 respectively formed on and protruding from two opposite inner walls of the compression arm 42 and respectively aligning with the positioning grooves 413.

The stretcher assembly 61 is mounted around the first shaft 13, the clamping sleeve 41 and the compression arm 42, and is pivotally connected to the second pivot holes 415 of the clamping sleeve 41. The stretcher assembly 61 has a top surface 611, two sidewalls 612, a plate insert slot 621, a spring channel 622 and a locating hole 623. The top surface 611 has a top hole 613 formed through one end of the top surface 611 opposite to the first shaft rack 12. Each sidewall 612 has a first abutting edge 614, a second abutting edge 615, a tooth 616 and a pivot hole 617. The first abutting edge 614 is intersected by the top surface 611 and the sidewall 612. The second abutting edge 615 is connected with the first abutting edge 614 and is opposite to the first shaft rack 12. The tooth 616 is formed on and protrudes from a portion of an inner wall of the sidewall 612 adjacent to the first pivot holes 414. The two pivot holes 617 are respectively formed through the sidewalls 612, align with each other, and are pivotally and respectively connected to the second pivot holes 415 of the clamping sleeve 41. A distance from the pivot hole 617 to the first abutting edge 614 is smaller than that from the pivot hole 617 to the second abutting edge 615. The plate insert slot 621 is formed in and recessed from an end edge of the top surface 611 opposite to the first shaft rack 12 and communicates with the top hole 613. The spring channel 622 has a circular cross section and is formed in a top inner wall and a bottom inner wall of the plate insert slot 621. The locating hole 623 is downwardly formed through an inner wall of the spring channel 622 and is elongated.

The anti-pinch assembly 70 is mounted in the stretcher assembly 61 and has a spring 71 and an anti-pinch plate 72. The spring 71 is mounted in the spring channel 622, and one end of the spring 71 abuts against an inner wall of the plate insert slot 621 facing the second shaft rack 22. The anti-pinch plate 72 is mounted in the plate insert slot 621, has a pin 721 and a locating piece 722, and one end of the anti-pinch plate 72 opposite to the first shaft rack 12 is located within the top hole 613. The pin 721 is formed on and transversely protrudes from one end of the anti-pinch plate 72 facing the first shaft rack 12, and is mounted in the other end of the spring 71. The locating piece 722 is formed on and protrudes from a bottom of the anti-pinch plate 72 and is mounted within and limited to move within the locating hole 623.

With reference to FIG. 1, the contact pads 80 are respectively mounted on the side edge of the first frame 11 on which the first shaft rack 12 is mounted and on the side edge of the second frame 21 away from the second shaft rack 22.

Figure 6:
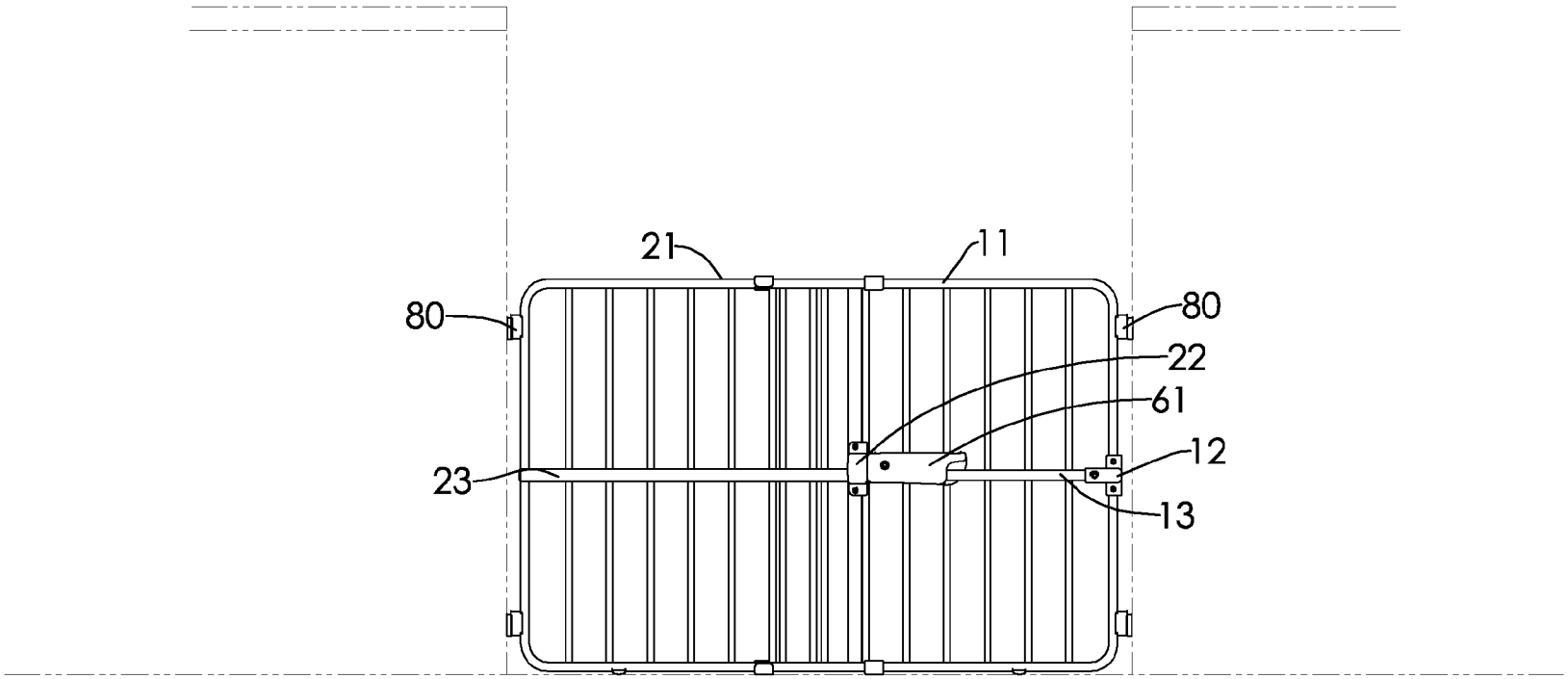
FIG. 6 is an operational front view of the safety gate in FIG. 1.

With reference to FIGS. 2 and 6 to 9, when the safety gate is in use, the compression arm 42 and the stretcher assembly 61 stay upright relative to the clamping sleeve 41. The first frame 11 and the second frame 21 are pulled to move and depart from each other transversely so as to slightly contact the walls as shown in FIG. 6.

Figure 7:
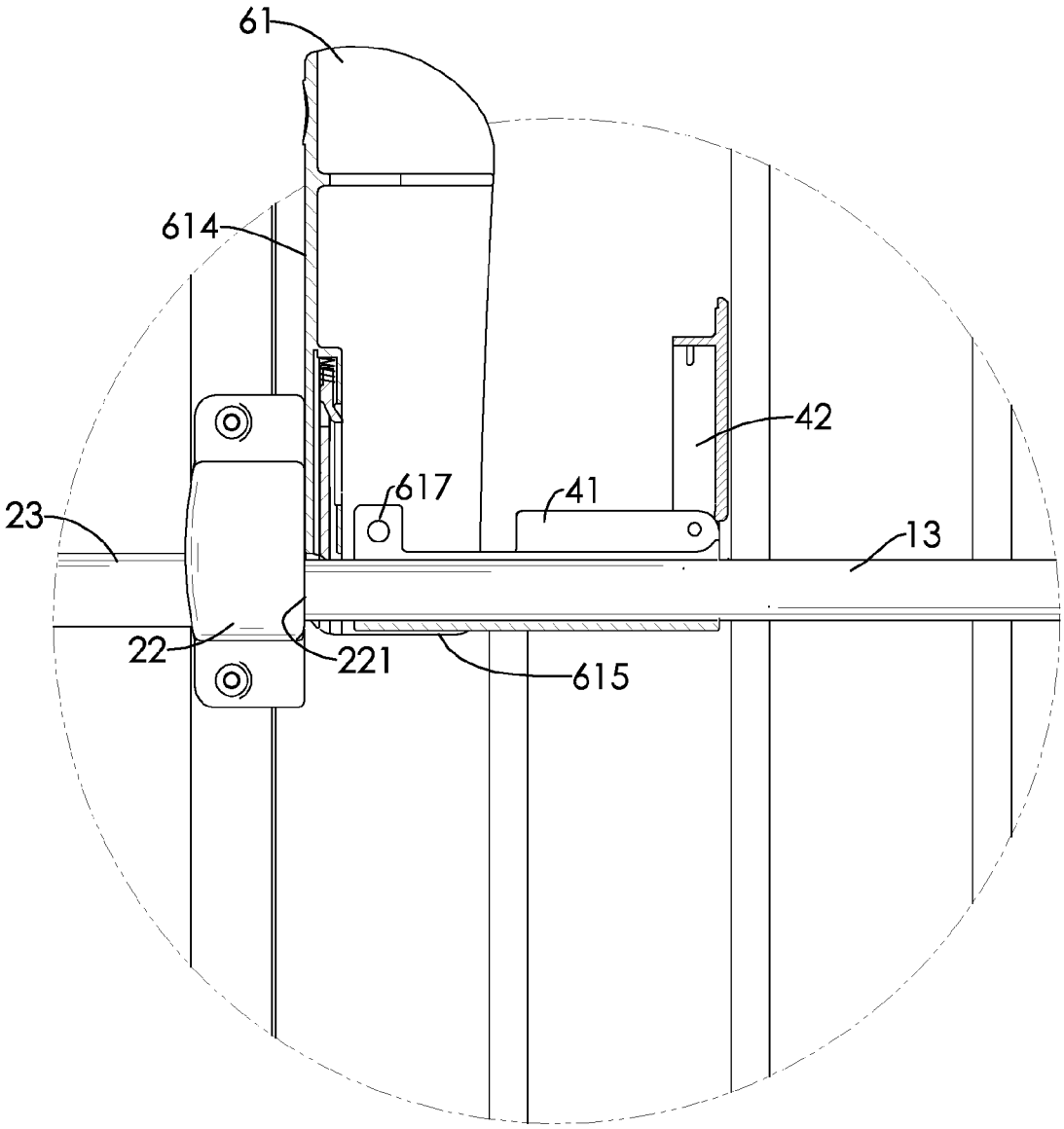
FIG. 7 is a first enlarged operational front view of the safety gate in FIG. 6.

The shaft fixing assembly 40 and the stretcher assembly 61 are then moved and the first abutting edge 614 of the stretcher assembly 61 abuts against the rack abutting surface 221 of the second shaft rack 22 as shown in FIG. 7.

Figure 8:
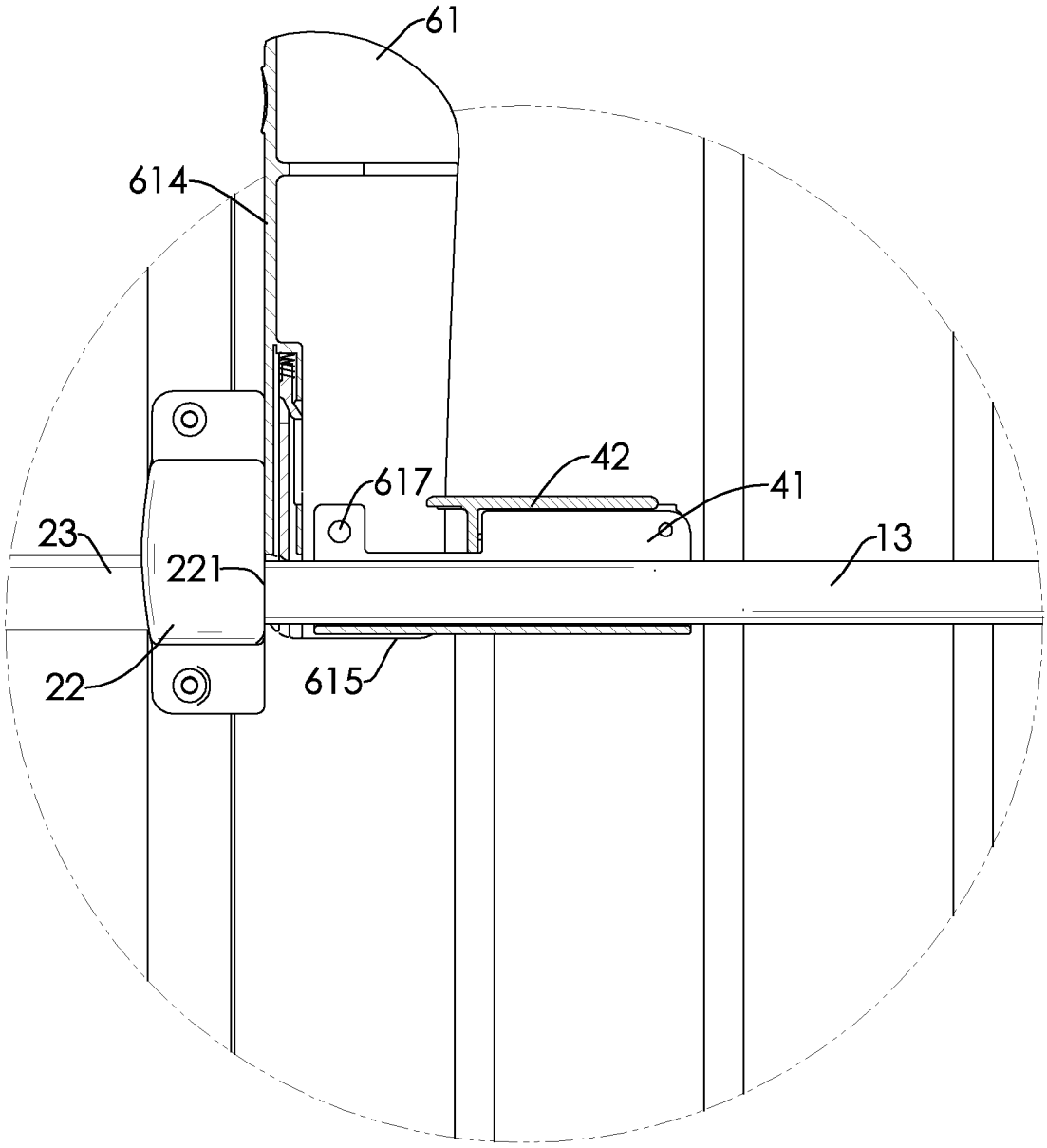
FIG. 8 is a second enlarged operational front view of the safety gate in FIG. 6.

The compression arm 42 is pivoted downwardly to cover the pressing walls 411 of the clamping sleeve 41 until the positioning rib 421 of the compression arm 42 engages the positioning groove 413 of the clamping sleeve 41 and the two sidewalls of the compression arm 42 hold and tightly squeeze the pressing protrusions 412 and the pressing walls 411. Accordingly, the shaft fixing assembly 40 and the first shaft 13 can be mutually fixed in the transverse direction as shown in FIG. 8. The mutual engagement between the positioning ribs 421 and the positioning grooves 413 holds the compression arm 42 on the clamping sleeve 41 in place.

Figure 9:
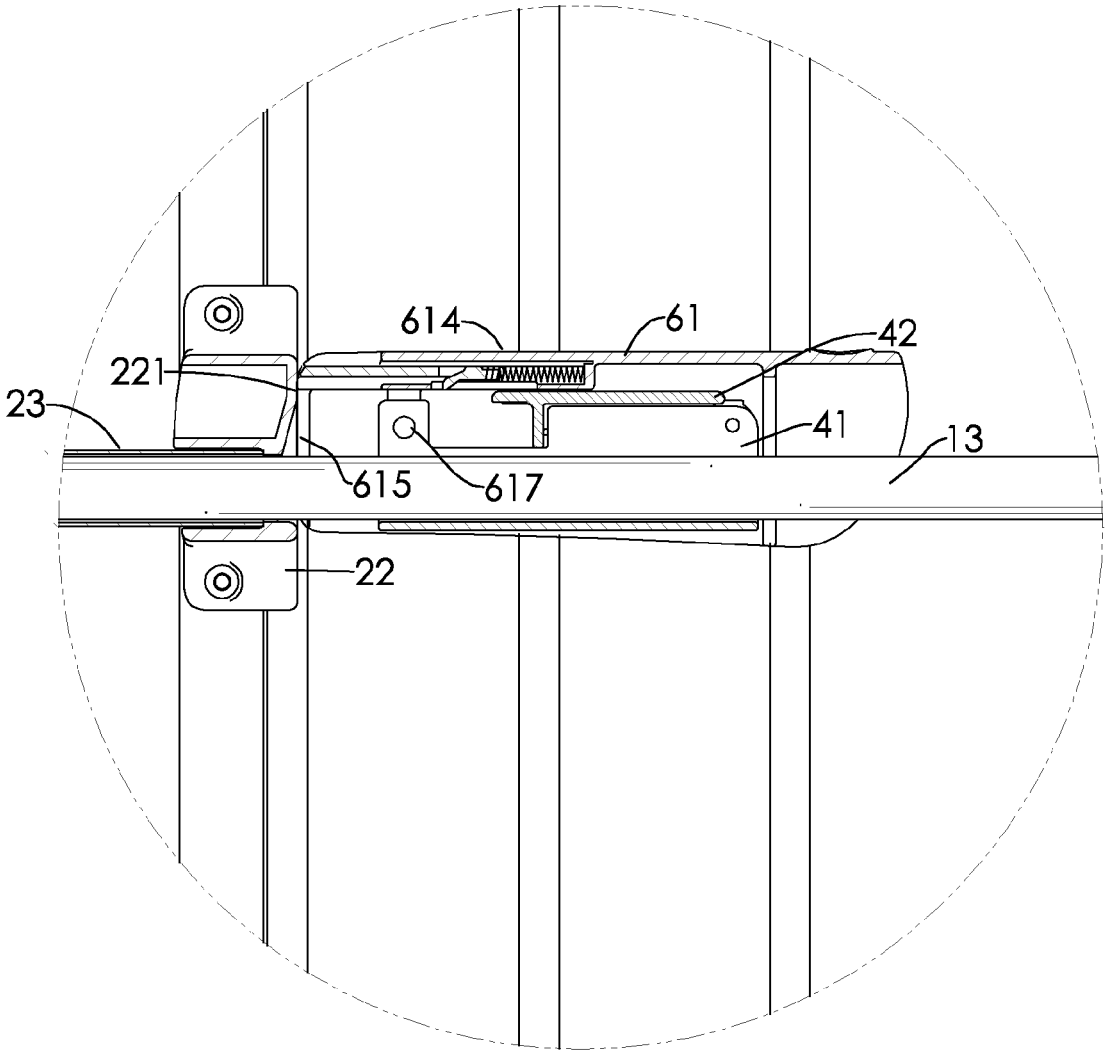
FIG. 9 is a third enlarged operational front view of the safety gate in FIG. 6.

The stretcher assembly 61 is pivoted downwardly to cover the compression arm 42 until the second abutting edges 615 of the stretcher assembly 61 fully abut against the rack abutting surface 221 of the second shaft rack 22 as shown in FIG. 9 and the teeth 616 are located under the first shaft 13 so that the first shaft 13 can be held and positioned by the teeth 616.

As the distance between the pivot hole 617 and the first abutting edge 614 is smaller than the distance between the pivot hole 617 and the second abutting edge 615, such difference in distance allows the stretcher assembly 61 to push the second shaft rack 22 and the second frame 21 away from the first shaft rack until the contact pads 80 of the second frame assembly 20 tightly abut against one of the walls. Meanwhile, as the stretcher assembly 61 is mounted on the shaft fixing assembly 40 and the shaft fixing assembly 40 is fixed on the first shaft 13, the reaction force exerted on the stretcher assembly 61 drives the first shaft 13 and the first shaft rack 12 to move away from the second shaft rack 22. Hence, the first frame assembly 10 is pushed to move away from the second frame assembly 20 until the contact pads 80 of the first frame assembly 20 tightly abut against the other wall to complete the mounting of the safety gate.

When the safety gate is not in use, the stretcher assembly 61 is pivoted upwardly so that the first abutting edge 614 abuts against the rack abutting surface 221 of the second shaft rack 22. As the distance between the pivot hole 617 and the first abutting edge 614 is smaller than the distance between the pivot hole 617 and the second abutting edge 615, the first frame assembly 10 and the second frame assembly 20 do not tightly and respectively abut against the walls, and the safety gate can be removed from the walls and stored elsewhere. When the safety gate is mounted on the same walls again, the first abutting edge 614 of the stretcher assembly 61 only has to abut against the rack abutting surface 221 prior to the mounting process. Then, the stretcher assembly 61 is pivoted downwardly and the contact pads 80 of the first frame assembly 10 and the second frame assembly 20 tightly and respectively abut the walls. As long as the clamping sleeve 41 is not loosened from the first shaft 13, the safety gate with the same relative distance between the first frame assembly 10 and the second frame assembly 20 can be repeatedly used at an identical mounting premise without requiring the readjustment of the relative distance between the first frame assembly 10 and the second frame assembly 20 at all.

When the second abutting edge 615 of the stretcher assembly 61 abuts against the rack abutting surface 221 of the second shaft rack 22, the top hole 613 faces up and is exposed and the anti-pinch plate 72 of the anti-pinch assembly 70 is located within the top hole 613 to prevent children from inserting their fingers into the top hole 613 and getting injured. When the first abutting edge 614 of the stretcher assembly 61 abuts against the rack abutting surface 221, the anti-pinch plate 72 gradually compresses the spring 71 for being propped by the first shaft 13 and empties out the top hole 613 so that the top hole 613 is available to receive the first shaft 13 and the stretcher assembly 61 can be pivoted as intended without being blocked by the first shaft 13.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A safety gate comprising:

a first frame assembly having:

a first frame;

a first shaft rack mounted on a first side edge of the first frame in a transverse direction relative to the one side edge's longitudinal axis; and a first shaft securely mounted on the first shaft rack;

a second frame assembly adjacent to a second side edge of the first frame in the same transverse direction and having:

a second frame mounted between the first frame and the first shaft;

a second shaft rack mounted on a side edge of the second frame adjacent to the first shaft rack in the same transverse direction, and having a rack abutting surface formed on the second shaft rack and facing the first shaft rack; and a second shaft securely mounted on the second shaft rack and being transversely slidable when combined with the first shaft;

a shaft fixing assembly mounted around the first shaft and having:

a clamping sleeve mounted around the first shaft and having:

two open sides;

an open top;

a chamber defined in the clamping sleeve and communicating with the open sides and the open top, wherein the chamber's cross section cut through a longitudinal plane perpendicular to the transverse direction corresponds to a cross section of the first shaft cut through the same longitudinal plane;

two pressing walls each respectively formed on and protruding upwardly from two top portions of the clamping sleeve;

two pressing protrusions each respectively formed on and protruding outwardly from peripheries of the two pressing walls;

two positioning grooves each respectively formed in the peripheries of the two pressing walls;

two first pivot holes, each pressing wall having one of said two first pivot holes at a first end of each respective pressing wall proximal to the first shaft rack and aligning with the other first pivot hole on the other pressing wall; and two second pivot holes, each pressing wall having one of said two second pivot holes at a second end of each respective pressing wall distal from the first shaft rack and aligning with the other second pivot hole;

a compression arm mounted above the clamping sleeve and having:

an open side;

an open bottom;

two inner walls being opposite to each other;

a chamber defined in the compression arm and communicating with the open side and the open bottom;

said two inner walls sandwiching the compression arm's chamber and respectively directly contacting the peripheries of the pressing walls when the compression arm is pivoted downwardly to rest on the pressing walls; and two positioning ribs respectively formed on and protruding from the two inner walls of the compression arm and respectively aligning with the positioning grooves when said arm is pivoted downwardly to rest on the pressing walls;

wherein the open side of the compression arm is pivotally connected to the first pivot holes of the pressing walls; and a stretcher assembly mounted around the first shaft, the clamping sleeve and the compression arm, said stretcher assembly pivotally connected to the second pivot holes of the clamping sleeve and having:

a top surface having a top hole formed through one end of the top surface distal to the first shaft rack; and two sidewalls, each sidewall having:

a first abutting edge intersected by the top surface of the stretcher assembly and the sidewall;

a second abutting edge connected with the first abutting edge and being distal to the first shaft rack; and a pivot hole formed through the sidewall to align with the pivot hole of the other sidewall, and pivotally connected to the second pivot holes of the clamping sleeve, wherein a distance from the pivot hole to the first abutting edge is smaller than a distance from the pivot hole to the second abutting edge.

2. The safety gate as claimed in claim 1, wherein the second shaft is hollow and tubular and has an opening formed through one end of the second shaft proximal to the second shaft rack, and the second shaft is unrotatably mounted around the first shaft.

3. The safety gate as claimed in claim 1 further comprising an anti-pinch assembly, wherein the stretcher assembly further has:

a plate insert slot formed in and recessed from an end edge of the top surface distal to the first shaft rack and communicating with the top hole of the top surface;

a spring channel having a circular cross section relative to a longitudinal axis of said stretcher assembly and formed in a top inner wall and a bottom inner wall of the plate insert slot; and a locating hole downwardly formed through an inner wall of the spring channel and being elongated;

the anti-pinch assembly is mounted on the stretcher assembly and has:

a spring mounted in the spring channel, wherein one end of the spring abuts against an inner wall of the plate insert slot proximal to the second shaft rack; and an anti-pinch plate mounted in the plate insert slot and having:

a pin formed on and transversely protruding from one side of the anti-pinch plate proximal to the first shaft rack, and mounted in the other end of the spring; and a locating piece formed on and protruding from a bottom of the anti-pinch plate, mounted within the locating hole, and limited to move within the locating hole, wherein one end of the anti-pinch plate distal to the first shaft rack is locatable within the top hole.

4. The safety gate as claimed in claim 2, further comprising an anti-pinch assembly, wherein the stretcher assembly further has:

a plate insert slot formed in and recessed from an end edge of the top surface distal to the first shaft rack and communicating with the top hole of the top surface;

a spring channel having a circular cross section relative to a longitudinal axis of said stretcher assembly and formed in a top inner wall and a bottom inner wall of the plate insert slot; and a locating hole downwardly formed through an inner wall of the spring channel and being elongated;

the anti-pinch assembly is mounted on the stretcher assembly and has:

a spring mounted in the spring channel, wherein one end of the spring abuts against an inner wall of the plate insert slot proximal to the second shaft rack; and an anti-pinch plate mounted in the plate insert slot and having:

a pin formed on and transversely protruding from one side of the anti-pinch plate proximal to the first shaft rack, and mounted in the other end of the spring; and a locating piece formed on and protruding from a bottom of the anti-pinch plate, mounted within the locating hole, and limited to move within the locating hole, wherein one end of the anti-pinch plate distal to the first shaft rack is locatable within the top hole.

5. The safety gate as claimed in claim 1, wherein the stretcher assembly further has two teeth, and each tooth is formed on and protrudes from a portion of an inner wall of a corresponding sidewall adjacent to the first pivot holes.

6. The safety gate as claimed in claim 2, wherein the stretcher assembly further has two teeth, and each tooth is formed on and protrudes from a portion of an inner wall of a corresponding sidewall adjacent to the first pivot holes.

7. The safety gate as claimed in claim 3, wherein the stretcher assembly further has two teeth, and each tooth is formed on and protrudes from a portion of an inner wall of a corresponding sidewall adjacent to the first pivot holes.

8. The safety gate as claimed in claim 4, wherein the stretcher assembly further has two teeth, and each tooth is formed on and protrudes from a portion of an inner wall of a corresponding sidewall adjacent to the first pivot holes.

9. The safety gate as claimed in claim 1 further comprising multiple contact pads respectively mounted on the side edge of the first frame on which the first shaft rack is mounted and on the side edge of the second frame distal from the second shaft rack.

10. The safety gate as claimed in claim 2 further comprising multiple contact pads respectively mounted on the side edge of the first frame on which the first shaft rack is mounted and on the side edge of the second frame distal from the second shaft rack.

11. The safety gate as claimed in claim 3 further comprising multiple contact pads respectively mounted on the side edge of the first frame on which the first shaft rack is mounted and on the side edge of the second frame distal from the second shaft rack.

12. The safety gate as claimed in claim 4 further comprising multiple contact pads respectively mounted on the side edge of the first frame on which the first shaft rack is mounted and on the side edge of the second frame distal from the second shaft rack.

13. The safety gate as claimed in claim 5 further comprising multiple contact pads respectively mounted on the side edge of the first frame on which the first shaft rack is mounted and on the side edge of the second frame distal from the second shaft rack.

14. The safety gate as claimed in claim 6 further comprising multiple contact pads respectively mounted on the side edge of the first frame on which the first shaft rack is mounted and on the side edge of the second frame distal from the second shaft rack.

15. The safety gate as claimed in claim 7 further comprising multiple contact pads respectively mounted on the side edge of the first frame on which the first shaft rack is mounted and on the side edge of the second frame distal from the second shaft rack.

16. The safety gate as claimed in claim 8 further comprising multiple contact pads respectively mounted on the side edge of the first frame on which the first shaft rack is mounted and on the side edge of the second frame distal from the second shaft rack.

* * * * *